United States Patent [19]

Cook et al.

[11] 4,281,310

[45] Jul. 28, 1981

[54] FOOT CONTROLLER

[75] Inventors: Albert N. Cook, Madison; Boleslaw Kornatowski, Elizabeth, both of N.J.

[73] Assignee: The Singer Company, Stamford, Conn.

[21] Appl. No.: 125,732

[22] Filed: Feb. 28, 1980

[51] Int. Cl.[3] ..... H01C 10/10

[52] U.S. Cl. ..... 338/108; 338/153

[58] Field of Search ..... 338/108, 111–113, 338/153, 164, 184, 199; 74/478, 512

[56] References Cited

U.S. PATENT DOCUMENTS

| | | | |
|---|---|---|---|
| 2,988,720 | 6/1961 | Voorles | 338/108 |
| 3,364,452 | 1/1968 | Thompson et al. | 338/108 |
| 3,639,877 | 2/1972 | Fresard et al. | 338/153 |
| 3,970,984 | 7/1976 | Grubenmann | 338/153 |

*Primary Examiner*—C. L. Albritton

*Attorney, Agent, or Firm*—James M. Trygg; Robert E. Smith; Edward L. Bell

[57] ABSTRACT

A round foot controller has a molded cover 75 attached to a molded base 11 by interengaging projections 79 and 16 extending in opposite directions toward each other from the rims of telescoping walls 77 and 13. The wall 77 is near the perimeter of the cover and is concentric with another wall 76 that surrounds the wall 77. The wall 13 concentrically surrounds another wall 14 in the base. The base has openings 96 and the cover has corresponding openings 97 left by the respective molds that form the undersides of the projections 16 and 79. The double-walled structure of the cover telescoping with the double-walled structure of the base prevents inadvertent access to the electrical components in the foot controller. However, the resistence of a variable resistor 21 or 103 in the controller, can be varied by pressure on any part of the cover 75.

15 Claims, 8 Drawing Figures

78
82
83
75
81
93
94
76
77
79
80
72
56
64
61
65
63
62
66
57
54
69
68
67
70
32
33
31
27
22
21
29
23
40
41
38
37
39
36
43
46
73
71
17
130
16
87
20
58
18
12
16
59
28
20
24
19
11
52
26
34
47
51
53
14
13
86
15
84
89
88
44
92
49
48
91
50
74
74

FOOT CONTROLLER

DESCRIPTION

Background of the Invention

This invention relates to the field of foot controllers to control the speed of electric motors and to control other electrical devices. In particular, it relates to a foot controller having a circular planform, and especially to molded controllers of the type suitable for use in controlling the speed of operation of a sewing machine.

Many foot controllers have been made heretofore with a generally rectangular planform or, if not rectangular, at least constructed to define a single hinge axis that determines the path of movement of the foot-actuated part of the controller relative to a stationary base part. Such controllers must be placed in a certain position to be used by a machine operator. Generally, this means that the axis should be approximately perpendicular to the longitudinally dimension of the operator's foot.

Other controllers that have a different type of movable member, such as a plunger, are also constructed so that they can best be operated only when the controller is placed in a certain position relative to the operator's foot.

Both of the foregoing types of foot controllers may have to be repositioned several times during a period of use in order to keep them in proper orientation with respect to the operator's foot. The repositioning is more or less annoying, but perhaps even more annoying is the fact that the controller can gradually shift out of position to the extent that, although it is not entirely properly oriented, it is not yet so far out of position as to require being put back into its proper place. Under such conditions, the operator may continue to use the controller for some little while in a slightly and increasingly awkward position before finally returning the controller to its optimum location.

It is desirable to be able to actuate a foot controller from any direction without having to be concerned with the orientation of any axis of the controller relative to the longitudinal dimension of the operator's foot. As a result, there have been several proposals to construct foot controllers with circular planforms so as to allow the operator to press on any edge of the controller to control the speed of the machine. In exercising such control, the heel of the operator's foot is usually placed on the floor adjacent the controller, and pivoting action is carried out in such a way as to cause the front part of the operator's foot to move up and down, pivoted about an axis generally perpendicular to the longitudinal dimension of the operator's foot and located at the area of contact of the operator's heel on the floor. This makes it desirable for the cover of the foot controller to be interlocked with the base around the common perimeter of the base and cover, but without any fixed interlocking that would establish a single axis. Thus, the instantaneous pivot axis of the foot controller, itself, will be on the opposite side of the controller from the operator's heel.

A foot controller arranged in the manner just described is shown in U.S. Pat. No. 3,970,984, in which segments that extend outwardly from the rim of the base engage segments that extend inwardly from the rim of the dome-shaped cover. The base could be molded, but the inwardly extending segments on the rim of the cover do not lend themselves to being molded. Depression of any part of the cover is transmitted by a pair of hemispherical members to a pivotally mounted arm, the free end of which slides along a resistive member to vary the resistance between two terminals in response to pressure by the upper hemisphere on the lower one when any part of the perimeter of the upper member is depressed. No matter which part of the perimeter of the cover is pressed downwardly, the cover pivots about an axis on, or close to, the diammetrically opposite side. The base has only one upwardly extending, peripheral, cylindrical member, and this single cylindrical member engages only a single cylindrical extending downwardly at the perimeter of the cover. In order to prevent the cover from being twisted relative to the base so as to align segments at the rim of the cover with gaps between segments at the rim of the base, a locking piece is provided on the external surface of the base in a position where it can easily be unscrewed, which would make it possible to open up the controller and expose the electrical elements inside it.

OBJECTS AND SUMMARY OF THE INVENTION

It is one of the objects of the present invention to provide a more secure foot controller with the base and cover locked together in such a way that they cannot easily be separated.

Another object is to provide an enter engaging base and cover, each of which has multiple cylindrical members that allow mold core openings to remain in the finished parts as are necessary to form interlocking projections and yet allow the base and cover to telescope together to form a tortuous path that prevents entry of anything that would interfere with the operation of the electrical components within the controller.

A further object of the present invention is to provide a circular foot controller housing capable of holding either the elements of a carbon pile rheostat or a linear motion potentiometer in position to be actuated by pressure on any part of the periphery of the cover.

Yet another object of the invention is to provide a foot controller less expensive to produce than controllers it is to replace.

Further objects will be apparent from the following specification together with the drawings.

In accordance with the present invention, a housing for a foot controller is formed by molding a suitable thermosetting phenolic resin to form a generally circular base and a dome-shaped cover that has a circular perimeter. The base is molded as a one-piece structure with a floor in the form of a disc and two concentric walls extending upwardly from the disc near the perimeter thereof. Support means are molded onto the upper surface of the disc within the inner cylinder to support a variable resistance element as well as contact means therefor and means to receive connections at the ends of a power cord. The outer cylinder has inwardly directed flange segments equally spaced apart by a distance just slightly greater than the arcuate length of each of the segments.

The dome-shaped cover has two short cylindrical walls extending downwardly from it and molded integrally with it near its perimeter. These cylinders are formed so that they can telescope with the cylinders extending upwardly from the floor of the base. The inner cylinder extending downwardly from the dome has outwardly extending projections formed during the molding of the base and each having the same arcuate length as each of the projections on the base. Each of these projections is spaced from its closest neighboring projection by the same arcuate distance as the spacing between adjacent segments on the base so that the arucate segments on the cover can pass between the segments on the base when the base and cover are being assembled.

In order to mold the projections on the base and the cover, the molds have cores that leave openings in the finished base and cover when these cores are retracted at the end of each molding operation. The double walls extending upwardly from the base and downwardly from the cover are an important safety factor in that they make it impossible to insert a wire or any other conductor straight through any part of the finished foot controller to contact or short-circuit any of the internal electrical apparatus.

A short, generally cylindrically rounded projection extends downwardly from the center of the cover to engage a bent wire actuator. This actuator is linked to means to vary the effective resistance of a resistive element held within the projections formed in the base. A torsion spring engages the wire member to press one part of it up against the generally cylindrically shaped projection on the underside of the dome while simultaneously pressing the variable resistance element firmly into position in the members in which it is held. The linkage between the wire member and the resistance element includes a member that is moved lengthwise along the resistance element, which, itself, is an elongated structure, when any part of the dome is depressed. The movement of this member along the longitudinal direction of the resistance element varies the effective resistance, either in the manner of a potentiometer, if the resistance element is a linear potentiometer, or in the manner of a rheostat, if the resistance element is a carbon pile.

DETAILED DESCRIPTION OF THE PREFERRED EMBODIMENTS

Figure 1:
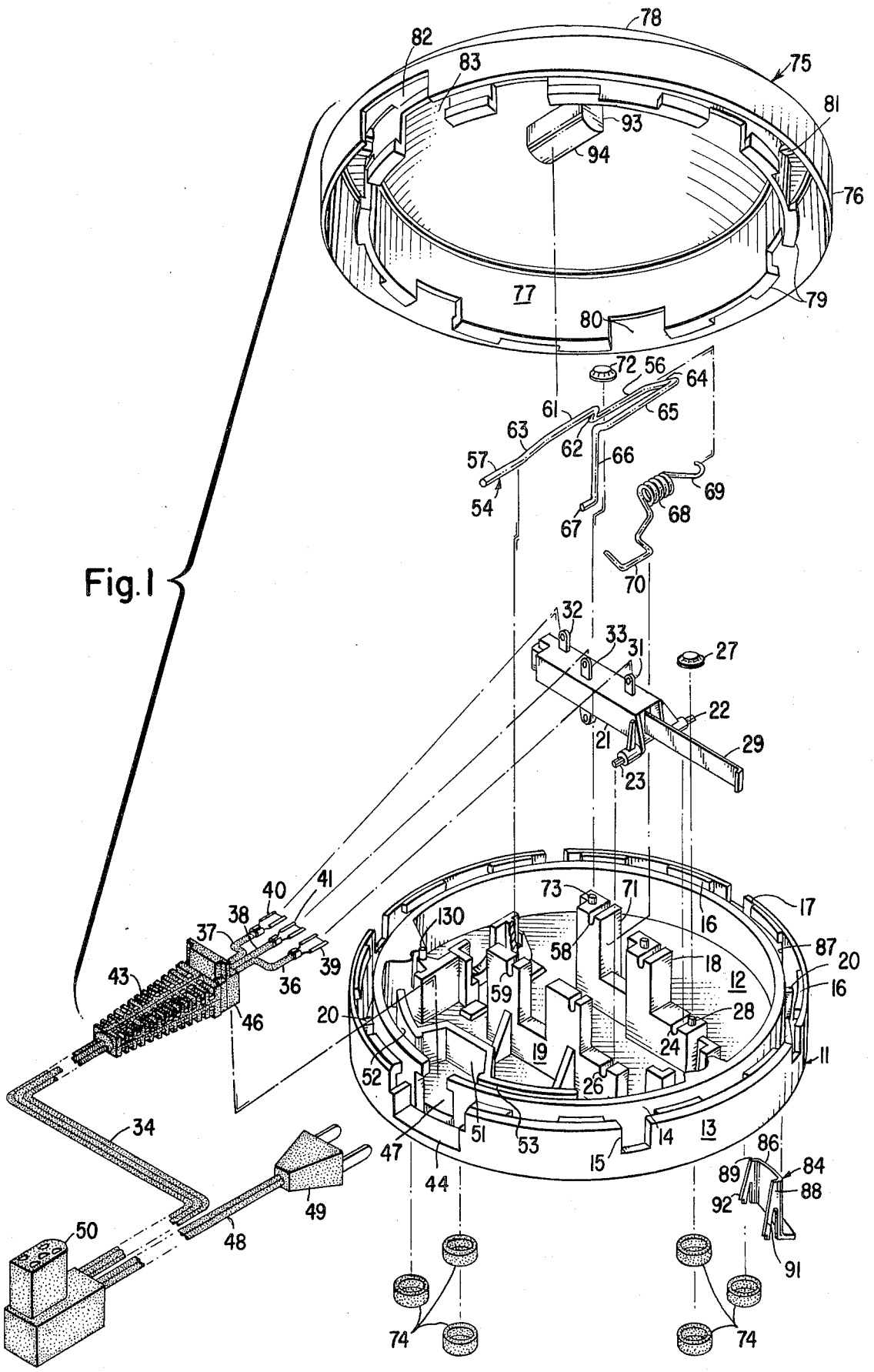
FIG. 1 is an exploded view of one embodiment of a foot controller incorporating the present invention.

The housing of the foot controller in FIG. 1 is molded as a two-part structure of a thermosetting phenolic resin or other moldable insulating material having good electrical insulating qualities and good resistance to mechanical impact. One of the molded parts is a round base 11 that has a floor in the form of a disc 12 having an outermost member which, because of its configuration in this embodiment, is called a cylinder 13 extending upwardly from the perimeter of the base. A second cylinder 14 concentric with the cylinder 13 and the base 12 is molded integrally with the other parts of the base and extends upwardly from the base approximately the same distance as does the cylinder 13.

One of the cylinders, preferably the outer cylinder 13, has a plurality of segmental projections 16 molded on the inner surface of its upper rim 17 to project inwardly. In this embodiment there are twelve of the projections 16, and the arcuate length of all of the projections is approximately equal, and the spacing between the segments is slightly greater than the arcuate length of the segments. As will be described hereinafter, this permits similarly formed, but oppositely directed, segments in the cover to fit between the segments 16 when the controller is assembled. In this embodiment six equally spaced notches 15 are formed in the upper rim 17 between alternate pairs of projections 16 to accommodate reinforcements, which will be discussed hereinafter, and there are six reinforcements 20 extending radially between the other alternate pairs of the projections 16.

The floor 12 has two support members, or bosses, 18 and 19 integrally molded with the remainder of the base 11 and extending generally parallel to each other along a central part of the floor. In the embodiment in FIG. 1, a potentiometer 21 has two oppositely directed stub axles 22 and 23 resting in a pair of notches 24 and 26, respectively, in the support members 18 and 19. The stub axles 22 and 23 permit the potentiometer 21 to rock, slightly, and one of the axles, for example, the axle 22, is held in place by a sheet metal ring clamp 27, pressed onto a lug 28 that forms part of the molded support 18. The upper surface of the support 19 is slightly higher than the upper surface of the support 18. This allows the notch 26 to be deeper than the notch 24 and yet the bottoms of these notches are the same distance from the floor 12. The extra depth of the notch 26 helps hold the potentiometer in place, as will be described later, without the necessity of providing another ring like the ring 27.

The potentiometer 21 is a well known control element that has an actuator 29 slidably supported by the body of the potentiometer and extending therethrough and beyond each end of the body. Within the potentiometer, and not visible in the drawings, is a resistive element connected electrically between terminals 31 and 32. A third terminal 33 is connected to a wiper that is mechanically attached to the actuator 29 to be moved thereby to any position along the resistive element. As will be clear from the above description the potentiometer 21 therefore, comprises a variable resistance means.

A connector cable 34 that includes three wires 36–38 has three connectors 39–41, respectively, connected to the terminals 31–33. A strain relief 43 extends through a gap 44 in the outer cylindrical wall 13, and an end portion 46 of the strain relief is held within an opening 47 in the inner cylindrical wall 14 to hold the wires 36–38 in place and prevent them from being easily pulled out of the base 11. The cable 34 is connected to a connector 50 of a standard type to be plugged into a sewing machine or other electrical device to be controlled by the foot controller. A power cord 48 connects the connector 50 to a plug 49 to be plugged into the usual receptacle.

A wall 51 is molded as part of the base 11 extending outwardly from the floor 12 and spaced inwardly from the opening 47. The wall 51 is arranged to leave channels 52 and 53 for the end portion 46 and the wires 36–38 extending therefrom to keep these wires out of the path of movement of the actuator 29.

A bent wire connector 54 includes two aligned parts 56 and 57 that serve as axles and rest in a pair of aligned notches 58 and 59, respectively in the supports 18 and 19. The notches 58 and 59 define an axis about which the connector 54 can be pivoted. A central part 61 of the connector 54 between the axle parts 56 and 57 is connected to them by arms 62 and 63, and one end of the axle part 56 is bent perpendicularly to form an arm 64. The end of that arm is bent back more or less parallel to the axle part 56, as shown by reference numeral 65, and the end 66 of the part 65 is bent so that it forms an arm that extends downwardly alongside the potentiometer 21. The extremity 67 of the arm 66 is bent at a right angle to fit into an aperture (not shown in FIG. 1) in the actuator 29.

The purpose of the connector 54 is to cause the actuator 29 to move longitudinally in one direction or the other with respect to the potentiometer 21 when the connector 54 pivots in one direction or the other about the aligned axle parts 56 and 57 in the notches 58 and 59.

A helical spring 68 is loosely held on the axle part 56. One end 69 of the spring is preferably bent to form a hook that engages the under side of the part 65, and the other end 70 of the spring is bent to fit around one side 71 of the support member 18.

As in the case of the notches 24 and 26, the notch 59 is deeper than the notch 58 and the upper surface of that part of the support 19 is farther above the floor 12 than is the corresponding surface of the support 18. Thus, only the axle part 56 need be held down by a sheet metal retaining ring 72 on a lug 73.

The base 11 rests on six cup-shaped feet 74 of rubber or other suitable elastomeric material that has a high coefficient of friction. The latter characteristic helps hold the foot controller in one place, even on a smooth floor, in spite of intermittent pressure applied by the operator's foot to an edge of a cover 75 during normal operation.

The cover is the other part of the foot controller that is molded of thermosetting phenolic resin. It has two concentric, cylindrical walls 76 and 77 extending downwardly from the outer part of a domed central portion 78. The inner surface of the outer cylindrical wall 76 has a slightly greater diameter than the outer surface of the outer wall 13 of the base 11 so that the outer part of the cover 74 substantially encloses the base 11.

The inner wall 77 of the cover has a plurality of projections 79 of uniform size and spacing extending outwardly from the lower end of the wall. The number and spacing of the projections 79 is identical with the number and spacing of the projections 16 extending inwardly from the wall 13 of the base 11, and the arcuate length of each of these segmental projections 16 and 79 is slightly less than the arcuate distance between proximal ends of adjacent projections 16 and 79, respectively. Thus, it is possible to align the projections 79 with gaps between the projections 16 in order to fit the cover 75 properly on the base 11. Six notches 80 are formed in the rim of the wall 77 to fit over the ribs 20 in the base 11 and six ribs 81 are formed between the walls 76 and 77 to fit into the notches 15 in the base when the cover 75 is pressed toward the base.

The inner surface of the wall 16 has a slightly greater diameter than the outer surface of the inner wall 14 of the base, and the outer surface of the wall 77 has a slightly smaller diameter than the inner extremity of the projections 16 of the base. Correspondingly, the inner surface of the wall 13 has a slightly greater diameter than the outer extremities of the projections 79 of the cover 75. The height of the wall 13 is great enough to allow the projections 79 to be passed between the projections 16 far enough to allow the cover 75 to be twisted into place with the projections 79 under the projections 16 but above the strain relief 46.

The outer wall 76 of the cover 75 has an opening 82 that is aligned with the opening 44 of the base when the base and cover are assembled together. This opening 82 is over the strain relief 43. Correspondingly, an opening 83 in the inner wall 77 is over the end portion 46 of strain relief to help hold this end portion in position within the opening 47 in the inner wall 14 of the base. The angular widths and the depths of the openings 82 and 83 in the cover 75 are great enough to clear the body of the strain relief 43 and the end portion 46, respectively, if the edge of the cover 75 directly over the strain relief is depressed to operate the foot controller.

After the cover is properly oriented with respect to the base, a clip 84 is inserted through an opening (not shown in FIG. 1) in the base 11 in a position beneath a selected projection **16*a* to hold the cover 75 and the base 11 in position to keep the projections 79 hooked to the projection 16. The clip 84 is preferably made of spring steel sheet formed to have a back 86 cylindrically curved to fit into a shallow recess 87 in the inner surface of the outer wall 13. The clip 84 has two sides 88 and 89 bent approximately perpendicularly to the vertical edges of the back 86. The sides 88 and 89 are tapered toward the upper edge of the clip and are cut out in such a way as to comprise legs 91 and 92 that hold the clip in place, as will be described latter in connection with FIG. 8**.

A projection 93 having a generally cylindrical lower surface 94 extends downwardly from the center of the dome 78. The orientation of the longitudinal dimension of the generally cylindrical surface is substantially perpendicular to the central portion 61 of the connector 54 when the foot controller is assembled. As a result, the pressure on the portion 61 by the surface causes the connector 54 to pivot about the axle portions 56 and 57 so as to move the end 95 the actuator 29 longitudinally toward the body of the potentiometer 21. The spring 68 biases the actuator 29 to the position shown with the end 95 away from the body of the potentiometer 21 when the surface 94 exerts no pressure on the central portion 61.

Figure 2:
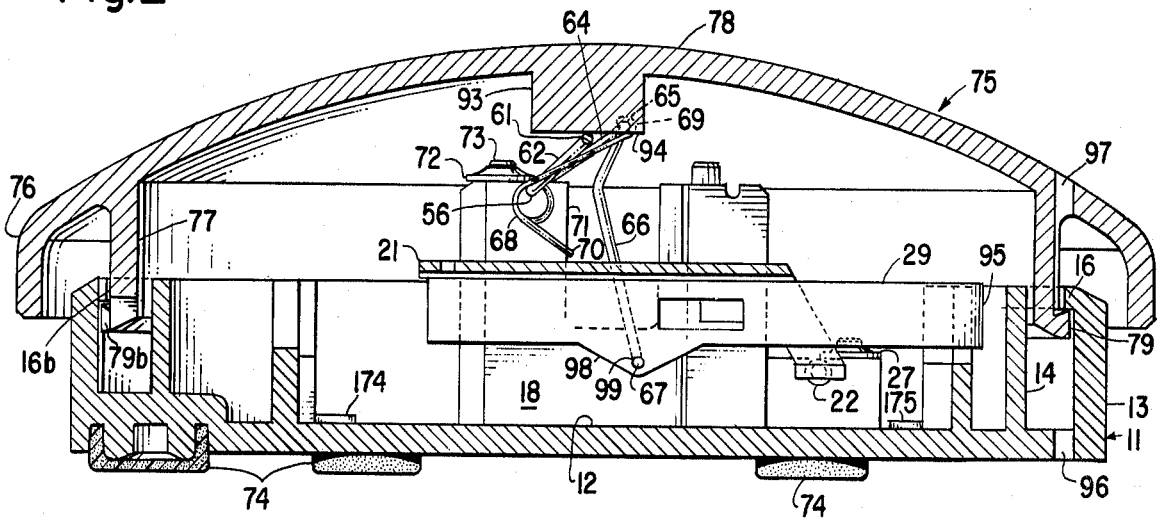
FIG. 2 is a cross sectional side view of the foot controller along the line 2—2 in FIG. 1.

FIG. 2 is a cross sectional view of the controller in FIG. 1. The cover 75 is assembled onto the base 11, and the projections 16 and 79 on the right-hand side are shown aligned with each other, which means that the cover has been twisted with respect to the base after the projections 79 were first passed between adjacent pairs of the projections 16. The sectioning plane does not cut straight across a diameter of the foot controller. On the right-hand side of FIG. 2, the sectioning plane passes through the middle of a pair of aligned projections 16 and 79. On the left-hand side of FIG. 2, the sectioning plane passes between the projection **16*b* and an adjacent projection. Therefore, the sectioning plane also passes between the projection 79*b* and an adjacent projection and through one of the cups 74**.

In order to mold a unitary structure to form the base 11, an opening 96 is formed in the floor 12 under each projection 16. The width of this opening in a radial direction from the center of the floor 12 is at least as great as the radial dimension of the respective projection 16, and the arcuate length of each opening 96 is at least as great as that of the respective projection. During the process of molding the base 11, a plurality of projections from the mold that shapes the bottom side of the base 11 extend into what would otherwise become open spaces between the walls 13 and 14 in order to define the undersides of the projections 16, and the openings 96 are left when those mold projections are withdrawn.

A similar group of openings 97 is formed in the cover 75 directly over each of the projections 79 to allow projections from the mold for the cover 75 to form the upwardly facing surfaces of each of the projections 79. The openings 96 and 97 required to form the projections 16 and 79, respectively, make it necessary to provide the inner wall 14 so that there can be no direct or easy access to the interior of the controller through the space between the ends of adjacent projections 16 and the corresponding projections 79.

FIG. 2 also shows the potentiometer 21 secured in the base 11. The actuator 29 is shown with its end 95 extending as far to the right as it is permitted to go. A projection 98 extends from the lower edge of the blade-like actuator 29 and has an aperture 99 through which the extremity 67 of the arm 66 extends.

Figure 3:
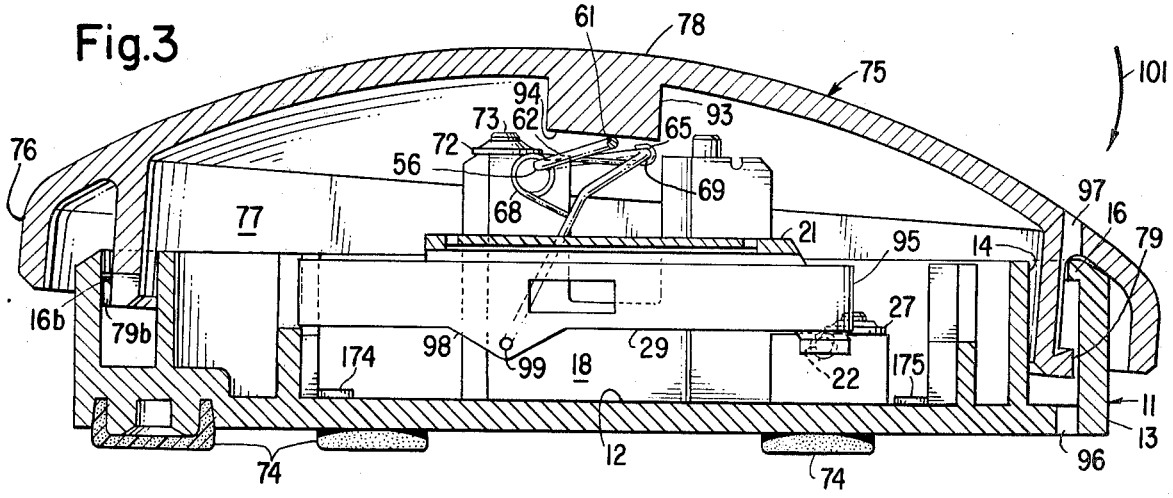
FIG. 3 is a cross sectional side view of the foot controller in FIG. 1 with one part of the perimeter of the cover depressed.

FIG. 3 shows the controller of FIG. 2 with one part of the edge of the cover 75 depressed in the direction indicated by the arrow 101. Operation of the controller is not limited to pressure on just one part of the cover 75; pressure at any point along the perimeter of the cover 75 will cause the cover to pivot about the inner section between a projection **16*b* and 79*b* on the opposite side of the controller. Since projections 16 and 79 are located all around the perimeter of the controller, it does not matter which part of the perimeter of the cover 75 is depressed; the pivot point will always be located on the diammetrically opposite side from the point of pressure. The cover 75 is also free to move straight down if axially directed pressure is exerted on the center of the dome 78**.

The exact extent of the motion may not be identical for the same amount of pressure at different points around the perimeter. The operator will not apply a specific amount of pressure to achieve a specific downward movement of the most depressed part of the cover 75 in order to achieve a specific change in the speed of the machinery controlled by the controller. Instead, the operator will simply apply enough pressure to make the desired change in speed of operation of the machinery without being aware of the precise deflection of the cover, provided the change of speed does not differ greatly according to which point on the cover 75 is depressed.

Pressure on the cover 75 causes the surface 94 to push downwardly on the central part 61 of the connector 54. This pivots the connector 54 about the axis of the axle parts 56 and 57, of which only the location of axle part 56 is indicated in FIG. 3, and this, in turn, pivots the arm 66 clockwise to shift the actuator 29 to the left. The actuator is connected to a sliding contact, as is well known, in the potentiometer 21, and this sliding motion of the actuator to the left causes a corresponding sliding motion of the movable contact and thus changes the setting of the potentiometer 21. The potentiometer is connected to an electronic control circuit, usually including a silicon controller rectifier (SCR) as the current controlling element, in a manner described in U.S. Pat. No. 3,364,452 and 3,374,758. The circuit, itself, forms no part of the present invention.

Figures 4, 8:
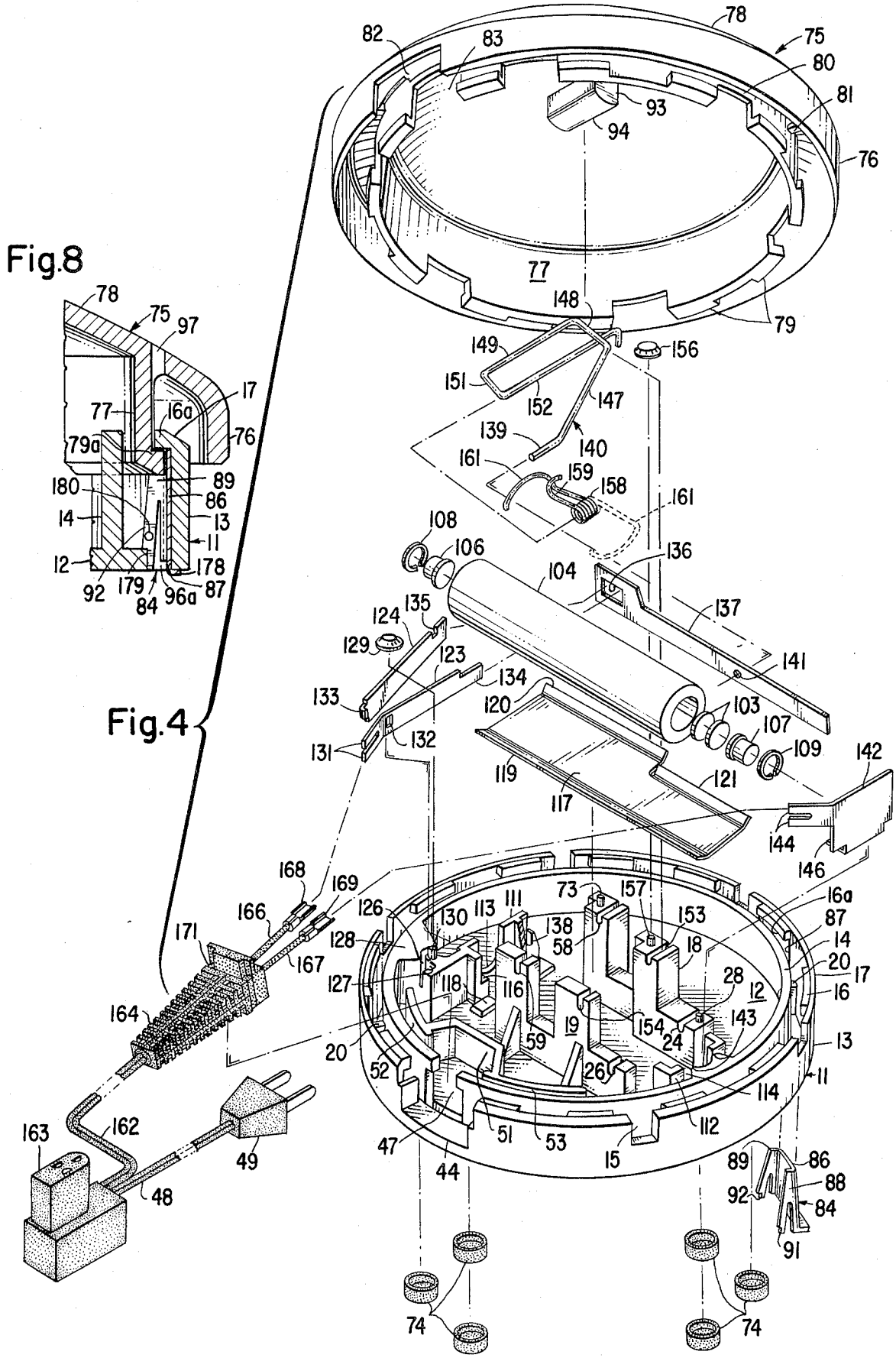
FIG. 4 is an exploded perspective view of another form of a foot controller according to the present invention.
FIG. 8 is a cross sectional view of a fragment of the foot controller in either FIG. 1 or FIG. 4. showing a detail of a locking member to keep the base and cover properly oriented after they have been assembled.

FIG. 4 shows another embodiment of a foot controller that uses the same base 11 and cover 75 as the embodiment in FIG. 1. All of the components that are the same in both FIG. 1 and FIG. 4 are identified by the same reference numerials and will not be described a second time.

The embodiment in FIG. 4 uses what is known as a carbon pile rheostat, referred to herein as variable resistance means. This rheostat includes a number of carbon discs 103 loosely stacked in a ceramic rod 104. Two contact members 106 and 107 are held within the ceramic tube 104 by a pair of C-shaped resilient holding rings 108 and 109. The ceramic tube 104 is located between the bosses 18 and 19 on opposite sides of the tube and between a pair of end bosses 111 and 112. The end boss 111 has a U-shaped saddle 113 in which the contact member 106 rests so as to be axially slidable relative to the ceramic tube 104. The ends of the ceramic tube 104 are supported on small corner shelves on each side of each of the bosses 111 and 112. Only one of the shelves 116 is shown in FIG. 4, but the other three shelves are similarly located at the other three corners of the bosses 111 and 112.

A carbon pile rheostat dissipates a substantial amount of heat, and therefore it is desirable to place a sheet metal heat shield 117 between the ceramic tube 104 and the core 12. The heat shield 117 is supported at its ends by raised platforms adjacent each of the bosses 111 and 112. Only a portion of the platform 118 is visible in FIG. 4. This platform need only be high enough to raise the heat shield 117 away from direct contact with the floor 12; a height of about 2 mm. is sufficient. The heat shield 117 is held in place by being forced between the bosses 18 and 19. In order to be sure that the heat shield remains in place, it is desirable to bend the edges 119–121 slightly upwardly so that it will be easier to force the heat shield 117 down into place between the bosses 18 and 19 than to remove it from that inserted position.

A contact member 123 and a spring 124 are assembled in a slot 126 between two portions 127 and 128 of the base 11 and held in place by a sheet metal ring clamp 129 pressed onto a lug 130. The contact member is bent slightly adjacent one end in which a pair of tines 131 are formed. An aperture 132 near the location of the bend in the contact member 123 receives a tongue 133 that extends from the end of the spring 124. This spring is also bent slightly to provide the necessary resilient action for proper operation, as will be described hereinafter.

As the end of the contact member 123 remote from the tines 131, a corner of the contact member has been removed to leave a slightly narrower end 134. The corresponding end of the spring 124 has only a notch 135 cut into it, but the width of the spring 124 between the bottom of the notch 135 and the opposite edge is approximately the same as the width of the end 134.

Both the end 134 and the corresponding end of the spring 124 extend through a generally rectangular opening 136 at one end of a drag link 137. The width of the opening 136 is sufficient to accommodate the width of the end 134 of the contact member 123 and the portion of the spring 124 between the bottom of the notch 135 and the opposite edge of the spring, and the length of the opening 136 allows the necessary operating movement as will be described hereinafter. The end of the link 137 at which the opening 136 is formed, rests in a notch 138 molded in the boss 111 and is freely slidable therein. The other end of the link is supported by an end 139 of a connector 140. The end 139 extends through an aperture 141 in the link 137.

At the other end of the ceramic tube 104 from the contact 123 is another contact 142 in the form of a brass plate that fits into a space between the boss 112 and another pair of bosses 143 that extend inwardly from the wall 14. The contact 142 has a pair of connector tines 144 that extend outwardly from one side, and it also has a support plate 146 bent perpendicularly to the main part of the contact 142 along the lower edge thereof.

The actuator 140 is in the form of a relatively stiff wire member that includes an arm 147, the lower end 138 of which connects with the drag line 137. At its upper end, the arm 147 is bent to form a lever arm 148, the outer end of which is bent perpendicularly to form a pressure bar 149. The other end of the pressure bar 149 is bent back to form a radius arm 151 that connects to an axle section 152. The axle section extends parallel to the pressure arm 149 and under the lever arm 148. The axle section rests in a pair of notches 153 and 154. The notch 153 is in the upper surface of the support member 18 and is relatively shallow. The notch 154 is in an upper surface portion of the support member 19, which is slightly higher than the upper surface of the support member 18. This allows the notch 154 to be deeper than the notch 153 and yet the bottoms of the two notches are at the same distance above the floor 12. The connector 139 is held in place in the notches 153 and 154 by a sheet metal ring clamp 156 that is pressed onto a lug 157 in the top surface of the support member adjacent the notch 153.

A spring 158 furnishes the force necessary to support the cover 75 so that the projections 79 all engage their corresponding opposed projections 16. In addition, the spring 158 supplies the force necessary to hold the pressure arm 149 in contact with surface 94 of the projection 93 on the under surface of the dome 78. In order to supply this force, the spring 158 is loosely held on the axle section 152, and one end of the spring is bent upwardly to form a hook 159 that engages the under side of the pressure arm 149. The other end of the spring 158 extends outwardly from the coil portion of the spring and is bent into an arc 161 that fits over the ceramic tube 104. In the relaxed position of the spring, the arc 161' is in the position shown in dotted lines, but when the spring is assembled with the other components in a complete foot controller, the arc 161 occupies the position shown in full lines relative to the hook 159.

Electrical connection to the contacts 123 and 142 is provided by a cable 162 connected to a plug 163 of a standard type to be inserted into a receptacle in a machine to be controlled by the foot controller in which the controlling element is a rheostat. The cable 162 is a two wire cable that extends through an elastomeric strain relief 164 from which it emerges as two separate wires 166 and 167. Wire 166 has a connector 168 at the end thereof and the wire 167 has a similar connector 169 at its outer end. The strain relief 164 has an enlarged end 171 that is pressed into the opening 47 in the wall 14 and fills that opening to the extent that is necessary to prevent any conductive rods or wires from being poked into the interior of the foot controller improperly. The wire 166 extends along the channel 52 and the connector 168 is slid onto one of the tines 131 of the contact 123. The other wire 167 extends along the channel 53 and its connector 169 is slid to one of the tines 144 of the contact 142. One end of a standard two wire power cord 48 is connected to the plug 163 and other end is connected to a standard plug 49.

Figure 5:
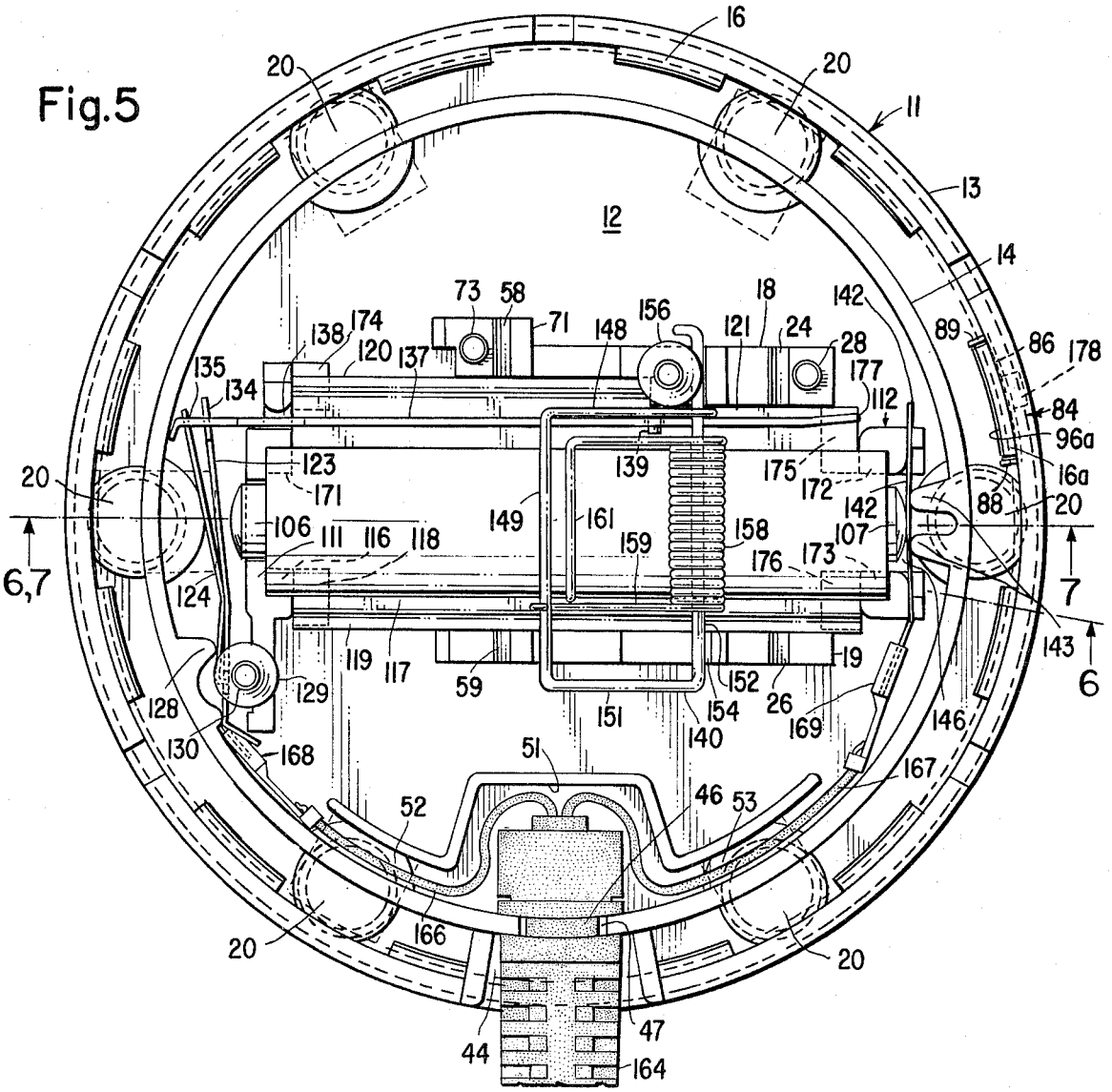
FIG. 5 is a plan view of the base of the foot controller in FIG. 4 with the electrical components assembled.

FIG. 5 shows the foot controller of FIG. 4 before the cover 75 has been put on. The ceramic tube 104 extends across the central part of the base 11 between the bosses 18 and 19. However, the ceramic tube is not in contact with either of the bosses but is held in place against the shelf 116 and three other shelves like it. One of these shelves 171 is also located on the boss 111 with the shelf 116. The other two shelves 172 and 173 are located on the other boss 112 at the other end of the ceramic tube. FIG. 5 also shows additional supports 174–176 similar to the support 118 for the heat shield 117.

The clip 84 is shown inserted in the recess 87, although this would not be done until after the cover 75 had been put in place. However, assuming that the cover had been attached to the base 11 by first orienting the projections 79 so that they could pass between the projections 16 and then rotating the cover to align each projection 79 with a projection 16, the sides 88 and 89 extend up alongside the projection 79 aligned with the projection **16*a* to keep these projection aligned. This keeps the entire cover 75 aligned unless the clip 84 is deliberately removed. In order to allow the clip 84 to slide into the recess 87, the opening 96*a* is made slightly larger than the other openings 96 are, or, at least, larger than they need to be. Or else the projection 79 under the projection 16*a* may be narrower in the arcuate direction than the other projections 79** need to be.

The link 138 is shown in its position farthest to the left in accordance with the fact that the cover 75 has not been put in place and therefore no pressure is exerted on the pressure bar 149. The spring member 124 is held by the portion 128 of the base 11 against the contact member 123, and the other end of the spring member 128, which has the notch 135 engaged with the opening 136 in the link 138, furnishes the resilient force to urge the link 138 to the left.

When the cover 75 has been put in place and pressure is applied at any point around its perimeter or at any other point within the perimeter of the cover, this pressure is exerted by way of the surface 94 of the projection 93 (FIG. 4) on the pressure bar 149 to press the bar 149 in the direction into the drawing in FIG. 5, thereby pivoting the connector 140 about its axle portion 152 and causing the end 139 to move to the right. This draws the link 138 to the right and first causes the contact member 123 to engage the contact member 106. If the contact member 107 is not also touching the contact member 142, pressure of the contact member 123 will cause this to happen, thereby establishing a relatively high resistance connection between the wires 166 and 167.

As increased pressure is put on the pressure bar 149 by the surface 94 (FIG. 5), the link 138 pulls the resilient member 135 farther to the right, thereby increasing the pressure on the contact member 134 and forcing the carbon discs 103 (FIG. 4) more firmly against each other. This lowers the resistance between the wires 166 and 167 until, finally, the carbon discs have been pressed as closely together as is posssible. Still further pressure on the pressure bar 149 causes the end 139 to move still further to the right and forces the end 177 of the link 138 against the contact member 142. This creates a direct, low impedance connection from the wire 166 through the contact member 134, the conductive link 138, and the contact member 142 to the wire 167 to cause the machine controlled by the foot controller to operate at its maximum possible speed.

Figure 6:
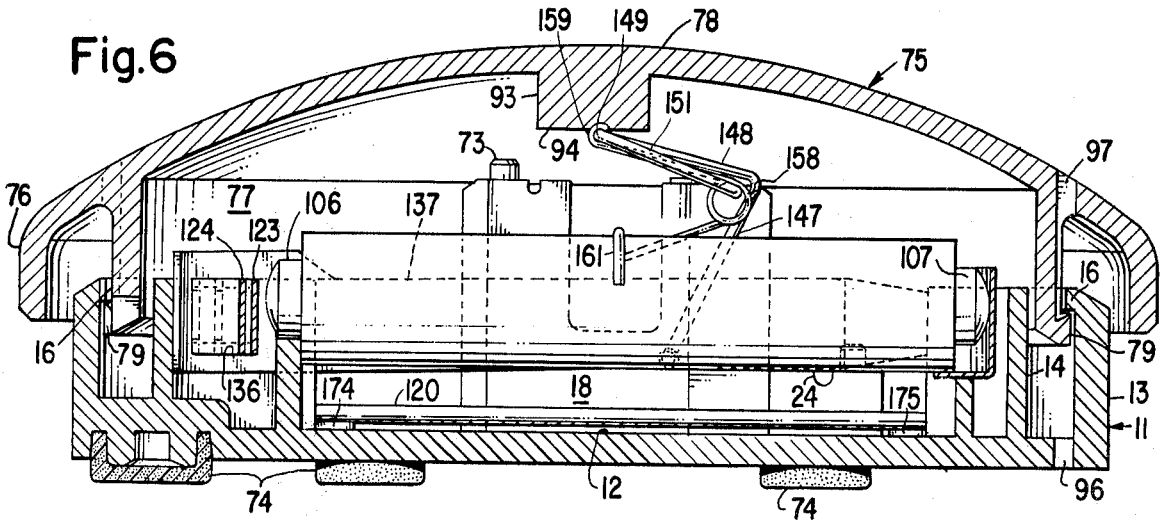
FIG. 6 is a cross sectional view of the foot controller along the line 6—6 in FIG. 5.

FIG. 6 shows a cross sectional view of the complete foot controller of FIG. 4 in its assembled condition but without any pressure on the cover 75. Thus, the pressure bar 149 is in its uppermost position, and the arm 147 is in its most clockwise position. The contact member 123 is not touching the contact member 106 so there is no circuit between the contact member 123 and the contact member 142 at the other end of the rheostat.

Figure 7:
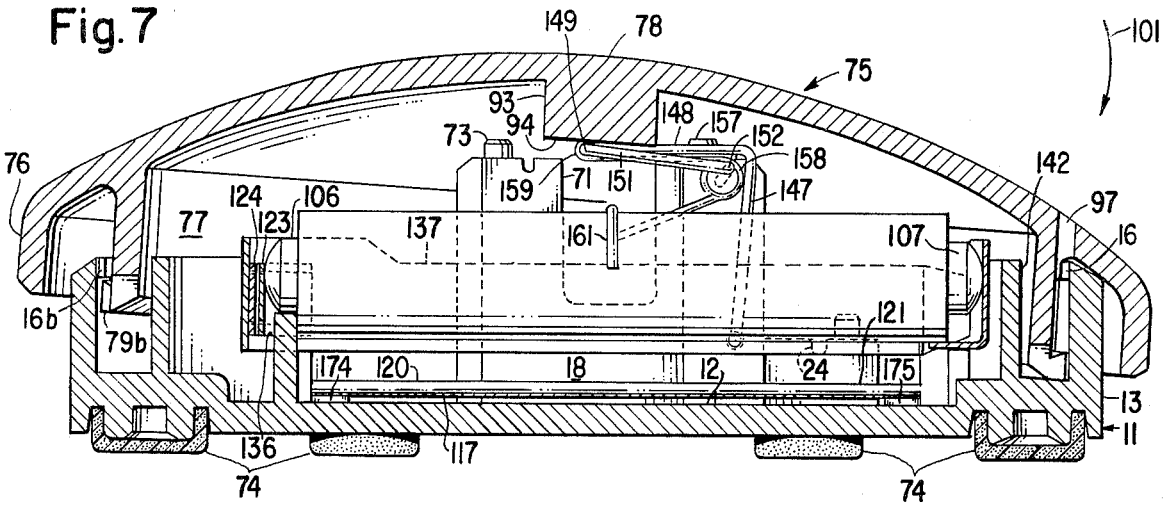
FIG. 7 is a cross sectional view of the foot controller in FIG. 5 with one side depressed.

FIG. 7 shows the foot controller of FIG. 6 with one side depressed according to the arrow 101. This pressure causes the surface 94 to force the pressure bar 149 downwardly, and it causes the arm 147 to move the link 138 to the right, bringing the contact member 123 firmly into engagement with the contact member 106 so as to establish a relatively low impedance path between the contact member 123 and the contact member 142.

The cover 75 could be pressed still farther down so as to rotate the arm 147 still farther in the counterclockwise direction and bring the end 177 of the link 138 into conductive engagement with the contact member 142 to establish essentially a short circuit between the contact members 123 and 142.

FIG. 6 shows the clip 84 in greater detail. Only one of the legs 92 is shown. As may be seen, this leg actually extends too far from the back 86 to fit into the slot 96 easily and must be momentarily compressed in order to force it into place in the recess 87. A flange 178 prevents the clip 84 from being pushed in too far. The lowermost end of the leg 92 has a notch 179 cut into it to engage an edge of the floor 12 at the opening 96 to prevent the clip 84 from being easily removed. However, if it is necessary to remove the clip, it may be done by forcing the leg 92 toward the back 86 to disengage the notch 179 from the floor 12. Such force may be applied to the leg by way of a tool inserted into a small aperture 180 near the lower end of the leg and just above the notch 179. Actually, there is a corresponding aperture in the other leg 91, since it is necessary to compress both legs toward the back 86 in order to remove the clip 84 from the inserted position shown.

We claim:

1. A foot controller comprising: a variable resistance means;

a first molded member comprising a round base molded of insulating material, the base comprising a floor, first and second coaxial cylindrical walls adjacent the perimeter of the base and defining an annular space therebetween, the first wall surrounding the second wall, a first set of projections angularly spaced apart and projecting into the annular space from one of the walls, and integrally formed boss means to support variable resistance means;

a second molded member comprising a cover molded of insulating material and comprising third and fourth coaxial cylindrical walls adjacent the perimeter of the cover, the third wall extending into the annular space between the first and second walls and having a second set of projections angularly spaced apart and projecting therefrom to engage the first set of projections, the arcuate length of each of the projections of the second set being less than the angular spacing between adjacent projections of the first set to pass therebetween, the internal diameter of the fourth wall being greater than the external diameter of the first wall of the base;

means to maintain the first and second molded members in a relatively fixed angular orientation to keep the projections of the first set engaged with the projections of the second set to keep the first and second molded members together while allowing limited axial and tilting movement of one of the molded members relative to the other; and resilient means to urge the molded members axially apart, thereby urging the first set of projections into engagement with the second set of projections.

2. The foot controller of claim 1 in which the first set of projections is integral with the inner surface of the first wall and the second set of projections is integral with the outer surface of the third wall.

3. The foot controller of claim 1 in which the first and second walls extend a substantially equal distance from the floor.

4. The foot controller of claim 1 in which the means to maintain the first and second molded members in a relatively fixed angular orientation comprises clip means insertable into an opening in the controller after the base and cover have been assembled together and have been oriented to bring the projections of the first set into alignment with the projections of the second set, the clip means engaging at least one of the projections of one of the sets and engaging the other molded member to lock the first and second molded members against rotation relative to each other.

5. The foot controller of claim 4 in which the first set of projections is molded as part of the inwardly facing surface at the rim of the first wall and the second set of projections is molded as part of the outwardly facing surface of the rim of the third wall.

6. The foot controller of claim 5 comprising, in addition:

a first set of openings in the floor of the base directly axially aligned with each of the first projections, respectively, and having at least as great a cross sectional area perpendicular to the axis as the respective projections of the first set; and a second set of openings in the cover directly axially aligned with each of the second set of projections, respectively, and having at least as great a cross sectional area perpendicular to the axis as the respective projections of the second set.

7. The foot controller of claim 6 in which at least one of the openings of the first set of openings is wider than the projection of the first set directly aligned with it, and the clip means comprises spring means insertable into the wider opening and comprising first and second portions to embrace the projection of the second set that engages said projection of the first set.

8. The foot controller of claim 7 in which the clip means comprises a resilient, sheet metal member, and the first and second portions comprise opposite edge portions of said member folded so that the cross sectional configuration of said member is generally U-shaped.

9. The foot controller of claim 1 comprising, in addition:

movable means connected to the resistence means to vary the resistance thereof; and connector means connecting the cover to the movable means to control the resistance of the variable resistance means in accordance with mechanical pressure applied to the cover to force any part of the cover toward the base, the resilient means being connected to the connector to urge the connector against the cover.

10. The foot controller of claim 9 in which the variable resistance means is a carbon pile comprising an insulating cylinder, carbon elements within the cylinder, and first and second conductive means at first and second ends, respectively, of the cylinder to apply pressure to the carbon element to vary the resistance between the contact means, and the movable means comprises:

a drag link extending alongside the carbon pile;

a resilient conductor clamped to the base adjacent one end of the carbon pile and mechanically connected to the drag link to be moved by the drag link into electrical contact with the first conductive means; and a second conductor adjacent the second end of the cylinder to be engaged by the second conductive means at least when the drag link presses the first conductor against the first conductive means.

11. The foot controller of claim 10 in which the drag link is conductive and makes electrical connection with the first conductor when the drag link presses the first conductor against the first conductive means, the drag link being moved into conductive connection with the second conductor when the cover is forced toward the base to a sufficient extent.

12. The foot controller of claim 10 in which the boss means comprises a pair of supports extending upwardly from the floor of the base on opposite sides of the insulating cylinder, and the connector means comprises a bent wire structure comprising an axle portion cradled in the supports and comprising an arm that extends alongside the cylinder, the drag link including an aperture into which an end of the arm extends to move the drag link generally longitudinally when the connector is pivoted about the axle portion by pressure of the cover on the wire member.

13. The foot controller of claim 12 in which the boss means comprises first and second end bosses, each comprising cylinder support portions to support the ends of the insulating cylinder, the base further comprising structural means spaced from the end bosses to provide first and second slots, the first conductor being mounted in the first slot and the second conductor being mounted in the second slot.

14. The foot controller of claim 10 in which the resilient means comprises a spring supported by the connector means and comprising an arcuate section at one end that engages the insulating cylinder to press the cylinder toward the floor of the base, and the other end engages the connector means to bias the connector means against the cover.

15. The foot controller of claim 1 in which the second molded member is dome-shaped and comprises a projection extending from the interior surface of the dome toward the base, the projection having a generally cylindrical surface facing the base.

* * * * *